US006076687A

United States Patent [19]

Huang

[11] Patent Number: 6,076,687

[45] Date of Patent: Jun. 20, 2000

[54] CLIP DEVICE FOR NEWSPAPERS

[76] Inventor: Ming-Tsung Huang, No. 1156, Chung Ming South Road, Taichung City, Taiwan

[21] Appl. No.: 09/129,068

[22] Filed: Aug. 4, 1998

[51] Int. Cl.[7] ..... A47F 5/00

[52] U.S. Cl. ..... 211/124; 211/45; 116/173

[58] Field of Search ..... 211/124, 45, 46, 211/105.1; 24/67.3; 116/173

[56] References Cited

U.S. PATENT DOCUMENTS

| | | |
|---|---|---|
| 28,234 | 5/1860 | Clark . |
| 132,478 | 10/1872 | Matthias . |
| 257,115 | 4/1882 | Weisz . |
| 340,305 | 4/1886 | Habitzreiter . |
| 380,246 | 3/1888 | Crofford . |
| 645,086 | 3/1900 | Green . |
| 690,837 | 1/1902 | Conzett . |
| 842,464 | 1/1907 | Ketzscher . |
| 884,226 | 4/1908 | Sioberg . |
| 922,229 | 5/1909 | Wiedeman . |
| 1,036,168 | 8/1912 | Updike . |

*Primary Examiner*—Robert W. Gibson, Jr.
*Attorney, Agent, or Firm*—Charles E Baxley, Esq.

[57] ABSTRACT

A clip device for clamping newspapers includes a beam having a longitudinal groove for receiving a bar which has one end pivotally coupled to the beam at a pivot shaft and which is rotatable outward and inward of the groove. A sleeve is slidably engaged on the beam for engaging with and for retaining the bar in the groove of the beam. A spring may bias the sleeve to engage with the bar. The sleeve includes an ear extended inward of the groove and engaged with the spring, and includes a projection extended outward for allowing a user to move the sleeve easily. The beam includes two end caps secured to the ends for enclosing the ends of the groove.

3 Claims, 4 Drawing Sheets

CLIP DEVICE FOR NEWSPAPERS

BACKGROUND OF THE INVENTION

1. Field of the Invention

The present invention relates to a clamp or a clip, and more particularly to a clip device for newspapers.

2. Description of the Prior Art

Typical clamp devices or clip devices for newspapers comprise a base tube having a clamping bar and a lock handle pivotally coupled thereto. The lock handle may be forced to engage with and to lock the clamping bar to the base tube. However, the users may be inadvertently hurt by the clamping bar and the lock handle when the clamping bar is locked d by the lock handle.

The present invention has arisen to mitigate and/or obviate the afore-described disadvantages of the conventional clip devices for newspapers.

SUMMARY OF THE INVENTION

The primary objective of the present invention is to provide a clip device for newspapers which includes a safety configuration for allowing the user to easily operate the clip device.

In accordance with one aspect of the invention, there is provided a clip device for newspapers in place, the clip device comprising a beam including a longitudinal groove, a bar received in the groove of the beam and including a first end pivotally coupled to the beam at a pivot shaft for allowing the bar to be rotated outward of the groove and to be rotated inward of the groove, the bar including a second end, a sleeve slidably engaged on the beam for engaging with the second end of the bar and for retaining the bar in the groove of the beam, and means for biasing the sleeve to engage with the second end of the bar.

The sleeve includes an ear extended radially inward and slidably engaged in the groove for guiding the sleeve to move along the beam and for preventing the sleeve from rotating relative to the beam. The sleeve includes a projection extended outward for allowing a user to move the sleeve easily. The beam includes two ends and includes two end caps secured to the ends of the beam.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
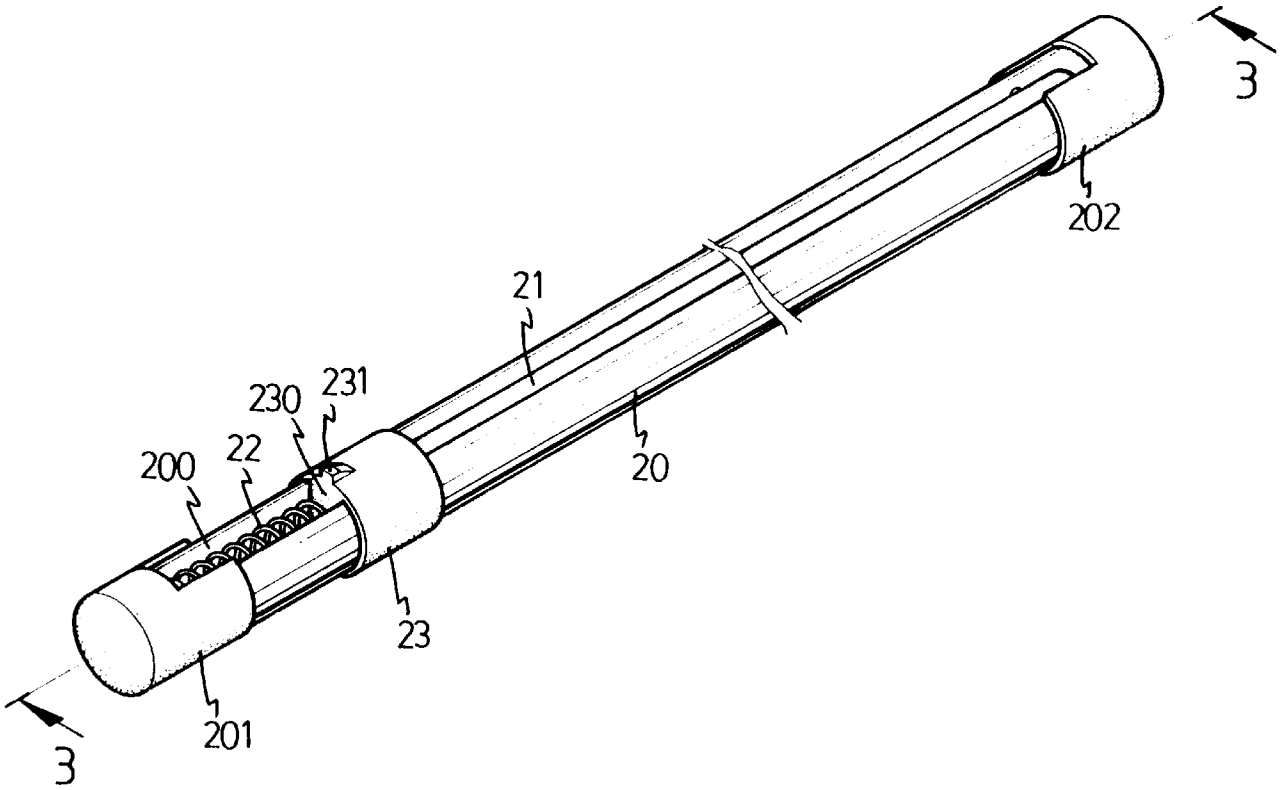
FIG. 1 is a perspective view of a clip device for newspapers in accordance with the present invention.
Figure 2:
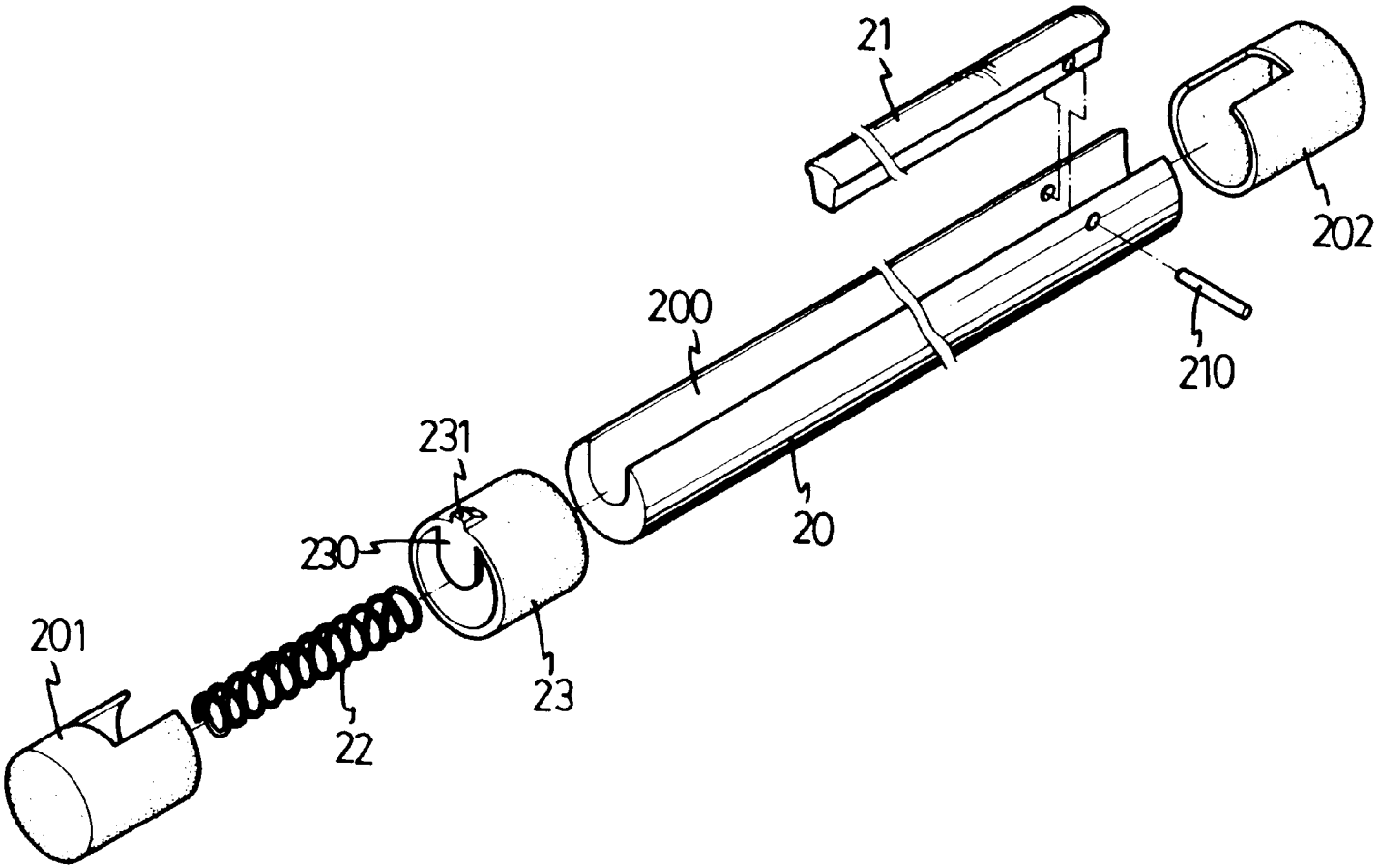
FIG. 2 is an exploded view of the clip device for newspapers.
Figure 3:
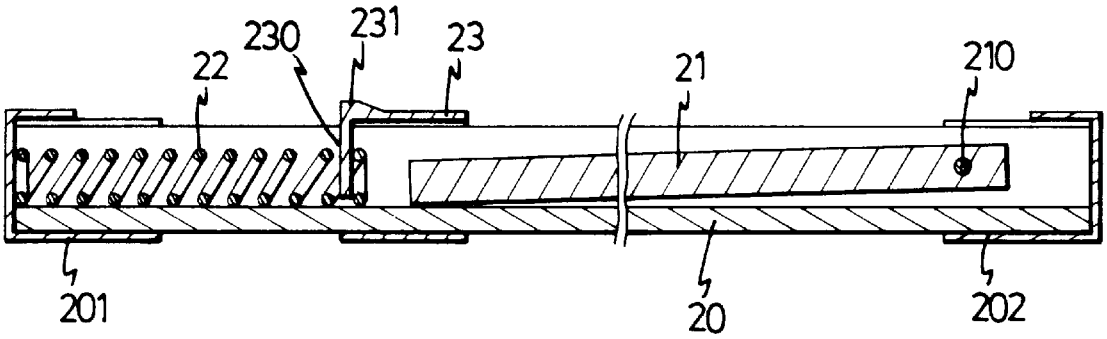
FIG. 3 is a cross sectional view taken along lines 3—3 of FIG. 1.

Referring to the drawings, and initially to FIGS. 1–3, a clamp device or a clip device in accordance with the present invention comprises a beam 20 including a longitudinal groove 200 formed therein for receiving a bar 21 which has one end pivotally secured to the beam 20 at a pivot shaft 210.

The groove 200 may include two open ends as shown in FIG. 1 and may, alternatively, include one or both of the ends enclosed by an end member or enclosed by an end cap 201, 202. A sleeve 23 is slidably engaged on the beam 20 and includes a projection 231 extended outward for forming as a hand grip or a push button. The sleeve 23 includes an ear 230 extended radially inward and slidably engaged in the groove 200 for guiding the sleeve 23 to rotate along the beam 20 and for preventing the sleeve 23 from rotating relative to the beam 20. A spring 22 is engaged between the end cap 201 of the beam 20 and is engaged with the ear 230 of the sleeve 23 for biasing the sleeve 23 toward the bar 21 and to engage with the bar 21 (FIG. 3). Without the end cap 201, the spring 22 may be directly secured to the beam 20.

Figure 4:
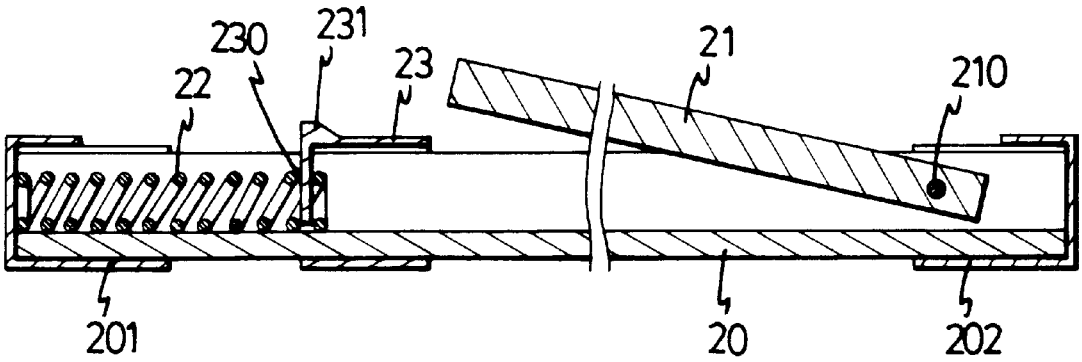
FIG. 4 is a cross sectional view similar to FIG. 3, illustrating the operation of the clip device.

In operation, as shown in FIG. 3, the free end of the bar 21 may be retained in the groove 200 of the beam 20 by the sleeve 23 when the sleeve 23 is biased toward the bar 21 by the spring 22, such that the bar 21 may not be rotated outward of the beam 20 and such that the newspapers may be clamped in place by the beam 20 and the bar 21. As shown in FIG. 4, when the sleeve 23 is moved away the bar 21 and moved against the spring 22, the free end of the bar 21 is disengaged from the sleeve 23 such that the bar 21 may be rotated about the pivot shaft 210 and may be opened for engaging the newspapers between the beam 20 and the bar 21. The clip device may thus be easily operated. The users will not be hurt by the sleeve 23.

Accordingly, the clip device for newspapers in accordance with the present invention includes a safety configuration for allowing the user to easily operate the clip device and for preventing the users from being hurt by the clip device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clip device for clamping newspapers in place, said clip device comprising:

a beam including a longitudinal groove formed therein, a bar received in said groove of said beam and including a first end pivotally coupled to said beam at a pivot shaft, for allowing said bar to be rotated outward of said groove and to be rotated inward of said groove, said bar including a second end, a sleeve slidably engaged on said beam for engaging with said second end of said bar and for retaining said bar in said groove of said beam, and means for biasing said sleeve to engage with said second end of said bar, wherein said sleeve includes an ear extended radially inward and slidably engaged in said groove for guiding said sleeve to move along said beam and for preventing said sleeve from rotating relative to said beam.

2. A clip device for clamping newspapers in place, said clip device comprising:

a beam including a longitudinal groove formed therein, a bar received in said groove of said beam and including a first end pivotally coupled to said beam at a pivot shaft, for allowing said bar to be rotated outward of said groove and to be rotated inward of said groove, said bar including a second end, a sleeve slidably engaged on said beam for engaging with said second end of said bar and for retaining said bar in said groove of said beam, and means for biasing said sleeve to engage with said second end of said bar, wherein said sleeve includes a projection extended outward for allowing a user to move said sleeve easily.

3. The clip device as claimed in claim 1, wherein said beam includes two ends and includes two end caps secured to said ends of said beam.

* * * * *